United States Patent [19]

Ashley

[11] Patent Number: 4,918,777

[45] Date of Patent: Apr. 24, 1990

[54] SLAB-STEM UNIT FORMING A TRAFFICWAY

[76] Inventor: Eddie L. Ashley, 3616 Ferry Ave., Niagara Falls, N.Y. 14302

[21] Appl. No.: 331,688

[22] Filed: Mar. 31, 1989

Related U.S. Application Data

[63] Continuation of Ser. No. 129,534, Dec. 7, 1987, abandoned.

[51] Int. Cl.[5] ..... E01D 15/12

[52] U.S. Cl. ..... 14/73; 14/75; 404/41; 404/43

[58] Field of Search ..... 14/73, 75, 1; 404/41, 404/43, 70, 71; 52/156, 157, 165

[56] References Cited

U.S. PATENT DOCUMENTS

| | | | |
|---|---|---|---|
| 207,228 | 8/1878 | Wasell | 14/75 |
| 2,035,007 | 3/1936 | Workman | 404/70 X |
| 3,114,302 | 12/1963 | Finsterwalder | 404/1 |
| 3,213,768 | 10/1965 | Jensen | 404/43 |
| 3,236,991 | 2/1966 | Graham et al. | 404/41 X |
| 3,460,446 | 8/1969 | Finsterwalder et al. | 404/71 |
| 3,503,216 | 3/1970 | Oquita | 404/43 X |
| 3,662,656 | 5/1972 | Finsterwalder et al. | 14/1 X |
| 4,753,411 | 6/1988 | Lechner et al. | 52/165 X |

*Primary Examiner*—Jerome W. Massie
*Assistant Examiner*—Matthew Smith
*Attorney, Agent, or Firm*—Donald C. Studley

[57] ABSTRACT

The present invention relates to interlocking construction elements useful in being assembled into load bearing traffic ways. The present construction elements are comprised of a flat top slab and at least one support stem attached perpendicularly to bottom of the slab. The top of the slab is a load bearing surface. The support stems have a flared, or finned, portion positioned contiguous to the junction of the stem and the bottom of the slab. A load placed atop the load bearing surface is equally distributed to the support stem, or stems. The slab may be considered as floating, that is, the bottom of the slab is in touch contact but not in support contact with the foundation. Any weight placed load bearing surface is immediately and directly transmitted to the support stem, or stems in substantially equal proportion. In an alternative embodiment of the invention the support stem, or stems, are secured into a anchor boot, which, in turn, is securedly attached to a foundation. The present elements are suitably utilized in conjunction with other similar elements which are suitably disconnectably interlocked with each other to form a stable, composite load bearing surface.

7 Claims, 3 Drawing Sheets

SLAB-STEM UNIT FORMING A TRAFFICWAY

BACKGROUND AND PRIOR ART

The present application is a continuation of U.S. Ser. No. 129,534 filed Dec. 7, 1987, abandoned.

The present invention relates to construction elements useful for assembly with similar elements into structures having load bearing surfaces suitable for vehicular or pedestrian traffic. Examples of such load bearing surfaces are: sidewalks, floors, walkways, bike paths, runways, and roadways, hereinafter collectively referred to as traffic ways. The present construction elements are unitary and preferably prefabricated. The present elements are particularly suited to assembly in situ to form a traffic way.

Although the construction elements of the present invention are adapted to use in a wide variety of load bearing structures, they are particularly useful in the construction of pedestrian traffic ways, such as, sidewalks, walkways and floors. The present elements are useful in the construction of entry, or ground, floors in large buildings that are exposed to heavy pedestrian traffic.

Normally construction of an in situ earth supported traffic way involves an initial subsurface evacuation, the preparation of a base or foundation, and subsequently the forming of a load bearing, or traffic, surface by paving, or by the laying of bricks, tiles, or slabs atop the prepared base. Generally such traffic ways are substantially permanent, that is, they are not easily moved or changed in direction. As such traffic ways age and deteriorate, especially in areas exposed to heavy traffic, or adverse weather conditions, the load bearing surface must be repaired. Repairing typically is in the form of repaving, patching or replacing. Repaving frequently raises the surface level which, in many cases, is undesirable. Patching is usually a temporary solution as once started, patching processes tend to become continuous. Replacement, the ultimate repair, requires removal of the faulty portion and a repeat of the initial preparation process.

To overcome the problems involved with such construction and maintenance, it has been previously proposed to construct traffic ways of separate, replaceable elements suited to assembly into traffic and load bearing structures. For example, U.S. Pat. No. 856,409 describes a concrete sidewalk constructed of separate interlocking planks laid over a base of slotted concrete stringers; U.S. Pat. No. 1,465,033 teaches a construction unit for road beds or flooring that is comprised of a rubber slab having downwardly projecting metal posts to secure the slab in place; U.S. Pat. No. 2,035,007 discloses a traffic way having a stem support which flares at the bottom (collar button type); U.S. Pat. No. 3,385,182 relates to interlocking metal planks useful to be assembled into load bearing structures; U.S. Pat. No. 3,859,000 teaches the use of an interlocking polygonal panels which are useful in constructing roadways; U.S. Pat. No. 4,445,802 relates to a prefabricated concrete components produced in a plurality of shapes which may be assembled into a sidewalk, and; U.S. Pat. No. 4,600,337 teaches the use of interlocking wooden mats which may be assembled into temporary roads. The foregoing represents the most relevant prior art related to the present invention to which applicant is aware.

While the present invention seeks to address the shortcomings of the present state of the art, it offers substantial additional advantages and flexibility in the areas of maintenance, repair, use, and appearance of traffic ways which were not previously available. For example, the present construction elements are easily assembled into a traffic way without extensive subsurface preparation; the elements may be easily removed and reassembled into a newly directed traffic way; a single element may be removed and replaced, and; when used in building construction, the elements enable the easy availability to the area below the traffic way for the installation, repair, and maintenance of utility and heat lines which are frequently positioned in the underneath area. Further, the color, design, or structure of traffic bearing surfaces may be easily altered. This latter attribute of the present invention facilitates the floors in the foyers of large buildings to be simply and easily changed to compensate for wear; to have a traffic way that indicates, or directs, pathways, or; to have traffic ways which are changeable to be appropriate with the weather, or with a holiday or season.

BRIEF DESCRIPTION OF THE INVENTION

The present invention relates to interlocking construction elements useful in being assembled into load bearing traffic ways. The present construction elements are comprised of a top slab, or pad, and at least one bottom support stem. The slab, or pad, has a top, substantially flat, load bearing surface. The support stem, or stems, are attached perpendicularly to the bottom portion of the slab. The support stems have a flared, or finned, portion postioned contiguous to the junction of the stem and the bottom of the slab. A load placed atop the load bearing surface is thereby distributed to the support stem, or stems. When the criteria of the present invention are met, the slab portion may be considered as floating, that is, any weight placed load bearing surface is immediately and directly transmitted to the support stem, or stems, in substantially equal proportion. In a preferred embodiment the support stem, or stems, also acts as an anchor for the element by stabilizing the element in both horizontal and vertical directions. In an alternative embodiment of the invention the support stem, or stems, are secured into a anchor boot, which, in turn, is securedly attached to a foundation. The present elements are suitably utilized in conjunction with other similar elements which are suitably disconnectably interlocked with each other to form a stable, composite assembly having a substantially flat, horizontally disposed load bearing surface. The preparation of an earth foundation for an installation of the present traffic ways is minimal, generally requiring only a pregrading, a postioning of an anchor means for the support stems, if required, and preferably a layer of stone or gravel to enable drainage under the bottom of the traffic way.

Suitably the slab portions of the present invention are not supportively positioned by the ground or foundation, and preferably are spacedly, or substantially spacedly, positioned from the ground or foundation, such arrangement allows a substantially free flow of air and moisture between the bottom of the slab portion and the ground or foundation. The stem, or support, portions of the present traffic ways suitably extend and are in support contact with the ground or foundation at a level below the frost line. In this manner the slab portions of the traffic ways are not adversely displaced by heaving and consequent cracking caused by weather cycles of freezing and thawing.

In a modified embodiment of the invention, the construction elements may be adapted to use on solid foundations, for example, construction beams, or concrete slabs, or blocks. In such embodiment the elements may suitably have a base portion extending in a perpendicular direction from the base portion of the stem, or stems, for securing the elements to such foundation. In such embodiment the support stem, or stems, are suitably flared, or finned, outward toward the junction of the stem and base.

DETAILED DESCRIPTION OF THE DRAWINGS

The present invention will now be described in several preferred embodiments and in greater detail by reference to the accompanying drawings in which similar components are identified by like numbers in each of the separate views.

DETAILED DESCRIPTION OF THE INVENTION

Figure 1:
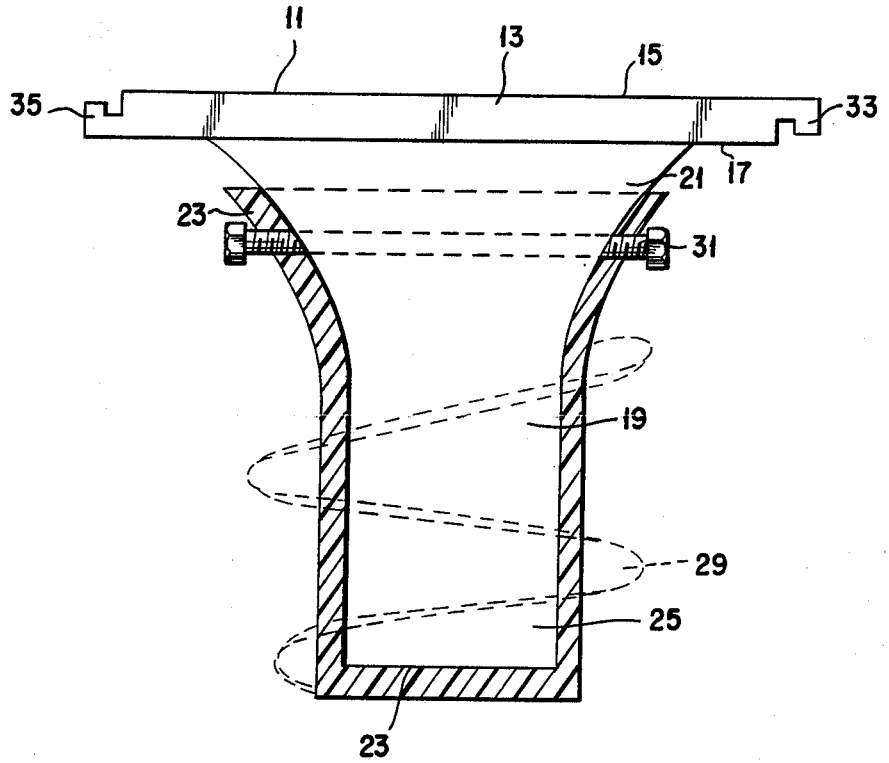
FIG. 1 is a front elevational view of a single construction element, shown partly in cross-section.

Looking now at FIG. 1, the present construction element is generally designated as 11. Element 11 is a unitary body having an upper portion comprised of slab, or pad, 13. Slab 13 is planar, having a substantially flat top and bottom surfaces, 15 and 17. Top surface 15 is the load, or traffic, bearing surface. Element 11 has a at least one intergal support stem, such as, 19 perpendicularly attached to bottom 17 of slab 13. Stem 19 is sized and positioned to receive and support a load placed upon surface 15 of slab 13.

Stem 19 has an outwardly tapered, or flared, portion 21. Flared portion 21 may be in the form of outwardly extending fins, or more preferably in the form of a solid outward extention of stem 19. The ratio of the surface area of the load surface 15 to the cross-sectional area of the non-tapered portion of support stem, or stems, 19 is critical. Further, the ratio of the cross-sectional area of the non-tapered portion of support stem, or stems, 19 to the cross-sectional area of the flared portion (or the area which would circumscribe the outwardly extending fins) at the juncture with slab 13 is also critical. The ratio of the load bearing area to the cumulative cross-sectional area of the support stems, measured along the non-tapered portion, ranges between about 4 to 1 to about 6 to 1, with a particularly useful ratio of about 5 to 1. The ratio of the cumulative cross-sectional area of the support stems, measured along a non-tapered portion, to the cross-sectional area of the flared portion measured at the junction with the slab portion 13, ranges between about 1 to 3 and about 1 to 12.5, with a particularly useful ratio ranging between about 1 to 2 and about 1 to 1.25. Flared portion 21 is preferably rounded and is tapered, length to height, at a ratio of between about 1 to 1 and about 4 to 1, and preferably between about 1 to 1 and about 1 to 3. When the components of the present elements are sized within the above proportions, the response of the load surface 15 to a load placed thereon is as if the load surface were floating as any load thereon is immediately, directly and proportionally transferred to the support stem, or stems.

When the present elements are utilized directly in earthen or ground locations, support stems, such as, 19 may be supported by a foundation, for example, concrete or rock, however, in such applications it is generally preferred to utilize an insert, or anchor boot, such as, 23. As shown in FIG. 1, support stem 19 is inserted with base portion 25 of stem 19 supported by the bottom portion of anchor boot 23. In a natural setting boot 23 may be secured, or supported, by earth or rocks, or may more preferably be threadedly engaged with the ground using a screw, or thread, means, such as, 29, shown in dashed lines in FIG. 2. Alternatively, boots, such as, 23 may be anchored on building sites by incorporation into the building foundation, by encasement in concrete, or by being otherwise suitably anchored, e.g., by bolts, industrial adhesives, or pinning.

In a particularly preferred embodiment stem 19 is releaseably secured within anchor boot 23. In such instances anchor boot 23 preferably secures stem 19 therein by means of a removeable locking pin, such as, 31. Bayonette-type fasteners may also be used.

Figure 3:
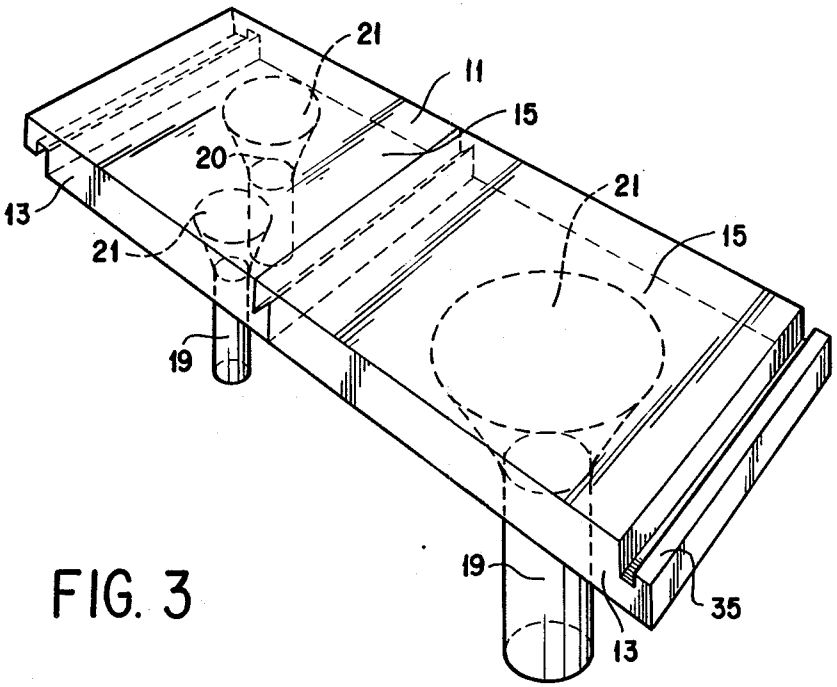
FIG. 3 is a perspective view illustrating a plurality of the present construction elements assembled into a unitary load bearing structure.

FIG. 1 also illustrates interlocking structures 33 and 35 postioned on opposite sides of element 11. The purpose of the interlocking structures is to provide a means of easily interconnecting or disconnecting adjacent construction elements. The interlocking structures suitably are engaging surfaces formed of a continuous downwardly extending lip, such as 33, and a continuous upwardly extending lip, such as 35, which form continuous male and female connections. Interlocking of the elements prevents excessive movement of the adjacent elements in either a vertical or a horizontal direction. In some structures, the connections may suitably be dovetailed to provide a more secure connection. An interlocked dovetail connection is shown in FIG. 3.

Figure 2:
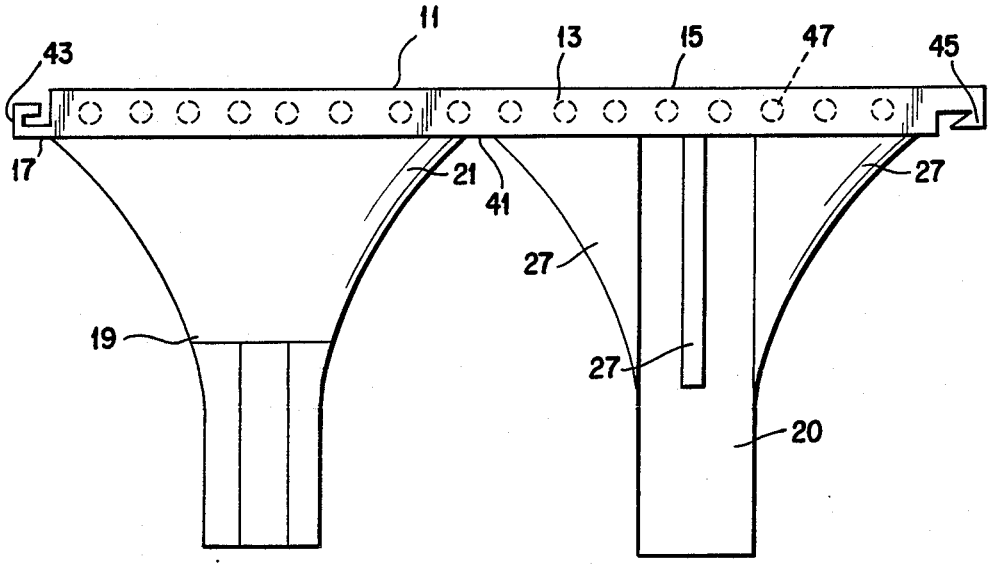
FIG. 2 is a front elevational view of an alternative embodiment of a construction element.

As illustrated in FIG. 2, element 11 may have more than one support stem, such as, 19 and 20. While a plurality of support stems may be utilized, it is preferred that the number of support stems not exceed five, and more preferably that the number not exceed two. Generally the more support stems that are used, the more difficult it is to distribute the load equally on each stem in the manner of the present invention. More than five support stems are usually not required and are uneconomical because the plurality of stems requires an equal number of prepared receiving areas, e.g., anchor boots or foundations, which substantially increases the installation cost and lessens the advantages of the present invention. If a single stem is utilized it is preferably centered in the bottom of slab 13. If two stems are utilized, they are preferably postioned at opposite corner portions of the slab. If three stems are utilized, they are preferably positioned equallaterally. If four stems are utilized they are postioned at the corner areas. If five stems are utilized they are postioned at the corners with one stem positioned in the center.

FIG. 2 also illustrates the use of fins in place of a solid flared portion. For example, stem 20 has outwardly extending fins, such as, 27, in place of a solid tapered portion, such as, 21, on stem 19. Fins, such as, 27, may extend the entire length of the stem member. An anchor boot, such as, 23, shown in FIG. 1, may suitably be slotted to receive such fin members to further stabilize and secure the stem members from undesirable latteral movement.

FIG. 2 further illustrates an embodiment wherein the stem member 19 is polysided. In such embodiment the anchor boot 23 is suitably equipped with a matching internal receiving area and in this manner stem member may be secured therein.

FIG. 2 also illustrates alternative embodiments of the interlocking means. For example, instead of an L-shaped interlocking portion as shown in FIG. 1, other forms of interlocking means may be utilized, such as, a G-shaped interlock, shown as 43, or a dovetail lock, shown as 45.

FIG. 3 illustrates a plurality of elements, such as, 11, assembled into a traffic way. It will be understood that elements 11 may also have additional complementary interlocking portions, such as 37 and 39 which, similar to interlocking portions 33 and 35, are located on opposite sides of elements 11. The additional interlocking portions may be utilized to expand the traffic way in width. For the purpose of better illustrating the present elements, the addition of elements along the side portions is not shown. Elements 11 interlock to form a substantially flat, coplanar load bearing surface. If desired the joints between slabs may be filled, or sealed, by appropriate sealing material.

FIG. 3 also illustrates a further embodiment of a dovetail interlock, 47, that may be utilized.

It is postulated that the strength and stability of the present assemblies is dereived from the intersupport from the flared areas 21. It is to be noted that a plurality of internal vaults, such as, 41, are formed as the present elements are joined into an assembly.

The site preparation for the installation of the present traffic ways consists of simply grading, if an earth site is to be utilized, installing anchor means, if they are required, and preferrably topping the site with a layer of gravel to provide a means of drainage. The base portions 15 of slabs 13 do not receive support from the site foundation. That is, slab 13 is positioned in touch contact, but out of support contact, with the ground site foundation and, except for the the support stem portion, is positioned to allow fluid flow, air or moisture, between the bottom of the slab and the ground or foundation. The stem portion is positioned in support contact with the ground or foundation at a level below the frost line. Such installation arrangement allows fluid flow under the traffic way and is particularly useful in preventing buckling and heaving and consequent damage to the slab by cracking caused by exposure to cycles of freezing and thawing.

As discussed in the foregoing support stems, such as, 19, may be circular, oval, or polysided in cross-section or they may have fins or outwardly extending projections thereon. In instances where the elements are to be frequently changed, it is preferred that the support stems be polysided and matched to a similar shape in the reveiving area of the anchor boot. Such arrangement is particularly useful in that it lends additional stability to the assembly in that the support stem is locked, or keyed, into, the anchor boot facilitating enabling easy alignment of the elements in the assembly.

The present construction elements may be fabricated of various materials depending upon the required or proposed use of the traffic way. In most cases the materials selected would be conducive to a long wear life for the traffic bearing surface. Other factors to be considered in the selection of materials are color, ease of cleaning, a non-skid or abrasive surface, and the size of the panels.

Although concrete, particularly reinforced concrete, is useful, it is particularly preferred that the elements be fabricated of a ceramic or plastic material. Plastics such as polypropylene or fluoroplastics, such as, polytetrafluoroethylene, ethylene-tetrafluoroethylene copolymer and polyvinylidene fluoride are eminently suited to use. Preferably plastic materials are reinforced using known reinforcing means. Aluminous metals are also useful. Electrically nonconducting materials are preferred because they minimize the potential danger of a lightning strike in the near vicinity of the traffic way and also provide a suitable media for embedding resistance, or heating coils, or grids, such as, 47, as shown in FIG. 2, within the elements for the control of ice or snow on the load surface. It is to be noted that heating elements 47, may be incorporated in selected areas of an element or in selected areas of an assembly of the elements, thus only a specific or desired path may be provided in the traffic way.

The present slabs may be fabricated of any desired size, however, they normally range from sidewalk size, generally from about 18 inches to about 4 feet on a side, to roadway size, generally from about 4 feet to about 8 feet on a side.

It will be understood that the present invention is not to be interpreted as limited to the illustrations given above and that the invention may be modified after the present disclosure without departing from the spirit and scope of the invention. It is to be expressly understood that the present invention is limited only by the appended claims.

What is claimed is:

1. A unitary construction element for use along with other similar elements to be assembled into a flat, horizontally disposed pedestrian traffic way, said elements adapted to be removeably secured to a site foundation, said structure comprised of a plurality of such elements disconnectively interlocked one with another to prevent substantial horizontal or vertical movement, said construction element comprising:

a. a unitary body, said body having an upper load bearing surface portion and a lower load supporting portion, b. said upper portion comprised of a rectangular slab having substantially flat top and bottom surfaces, said bottom surface in touch contact with said site foundation, c. said lower portion comprised of at least one integral support stem perpendicularly attached to said bottom surface of said slab, the bottom portion of said support stem, or stems, positioned in support contact with a site foundation separate anchor boot, d. said support stem, or stems, having a substantially uniform cross-section along the lower portions thereof to facilitate easy removal of the element from a site foundation, said stem, or stems, having outwardly flared upper portions positioned adjacent the junction of said stem, or stems, and said slab, e. the ratio between the surface area atop said slab and the cumulative cross-sectional area of the lower, non-flared portions of said stem, or stems, being between about 4 to 1 and about 6 to 1.

f. including a separate anchor boot designed to be secured into said site foundation and to receive a substantial portion of said stem.

2. The construction element of claim 1 wherein a plurality of stems are attached to the bottom surface of said slab.

3. The construction element of claim 1 wherein said support stem has outwardly extending fins.

4. The construction element of claim 1 wherein said slab has a heating means therein.

5. The construction element of claim 1 wherein said anchor boot has a threaded exterior.

6. The construction element of claim 1 wherein said element is releasably secured within said anchor boot.

7. The construction element of claim 1 wherein said element is secured within said anchor boot by a removeable lock pin.

* * * * *